United States Patent [19]

Robinson et al.

[11] Patent Number: 4,506,525

[45] Date of Patent: Mar. 26, 1985

[54] KNITTING MACHINE

[75] Inventors: Frank Robinson, Breaston; Max W. Betts, Falmouth, both of England

[73] Assignee: Courtaulds PLC, London, England

[21] Appl. No.: 554,455

[22] Filed: Nov. 22, 1983

[30] Foreign Application Priority Data

Nov. 22, 1982 [GB] United Kingdom ..... 8233271

[51] Int. Cl.[3] ..... D04B 15/06

[52] U.S. Cl. ..... 66/109; 66/64

[58] Field of Search ..... 66/60 R, 604, 64, 104, 66/110, 106

[56] References Cited

U.S. PATENT DOCUMENTS

| | | | |
|---|---|---|---|
| Re. 29,861 | 12/1978 | Dietschy et al. | 66/64 |
| 3,049,900 | 8/1962 | Bram | 66/60 |
| 3,613,401 | 10/1971 | Jeffcoat et al. | 66/60 |
| 4,027,504 | 6/1977 | Dietschy | 66/64 |
| 4,378,682 | 4/1983 | Betts | 66/64 |
| 4,398,401 | 8/1983 | Schimko . | |

FOREIGN PATENT DOCUMENTS

| | | |
|---|---|---|
| 58556 | 8/1982 | European Pat. Off. . |
| 1171555 | 6/1964 | Fed. Rep. of Germany . |
| 1223985 | 9/1966 | Fed. Rep. of Germany . |
| 867678 | 5/1961 | United Kingdom . |

*Primary Examiner*—Ronald Feldbaum

*Attorney, Agent, or Firm*—Davis, Hoxie, Faithfull & Hapgood

[57] ABSTRACT

To facilitate control of a presser foot between knocking over bits in a flat V-bed knitting machine, at least some of the knocking over bits have inner edges whose lower portions have a smooth profile and are inwardly inclined, in the downward direction, with respect to the knocking over bits of the opposite needle bed.

7 Claims, 1 Drawing Figure

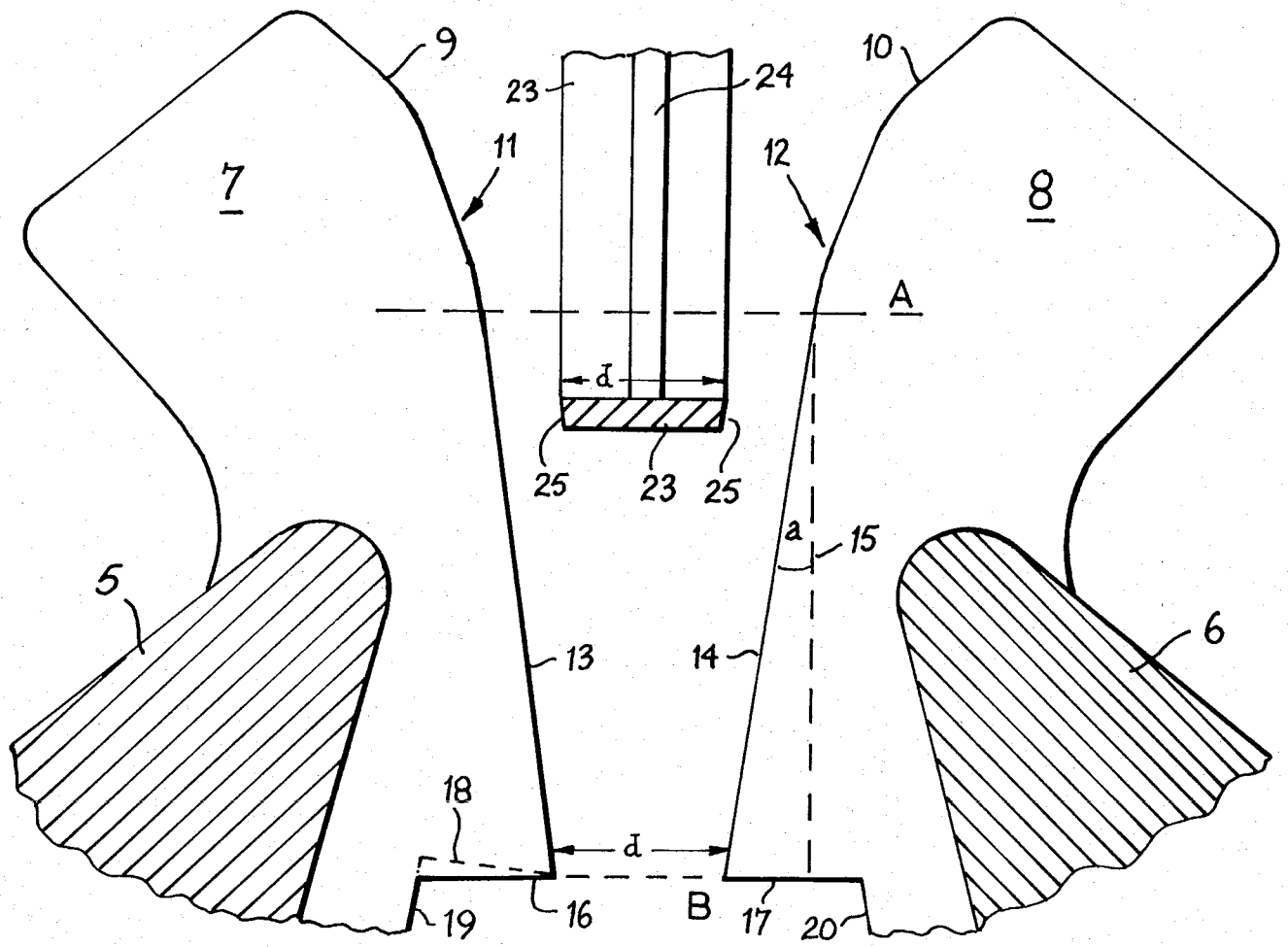
8
7
6
5
9
10
11
12
13
14
15
16
17
18
19
20
A
B
a
d
d
23
23
24
25
25

KNITTING MACHINE

BACKGROUND OF THE INVENTION

1. Field of the Invention

This invention relates to a flat V-bed knitting machine with improved knocking over bits.

The new knocking over bits are intended for use in a flat V-bed knitting machine fitted with a presser foot which is located between the knocking over bits of the two needle beds and holds down the knitted fabric from above, as opposed to the operation of conventional take-down rollers which pull down the fabric from below the needle beds.

2. Description of the Prior Art

When holding down rib fabrics, the presser foot acts on the yarn extending between the needles of the opposite needle beds in the machine and thus a narrow presser foot acting in a central region between the needle beds is satisfactory, or even advantageous. However, in order to hold down fabric knitted on a single bed of needles, the presser foot must act on loops of yarn located close to the knocking over bits of the needle bed and in fact extending, in each case, from a needle, around the front (inner) edge of an adjacent knocking over bit to an adjacent needle. Presser feet having a rectangular cross-section and wide enough to come close to the knocking over bit edges have been used for knitting single bed fabrics but have been found to have limitations with regard to the range of stitch lengths which can be knitted with a presser foot of given dimensions even if the inner edges of the opposite presser feet are made parallel to one another.

One reason for the difficulties which have arisen has been found to be that, as close examination shows, the gap between the opposed needle beds of a machine, and thus between the opposite, inner edges of the knocking over bits does not remain constant along the whole length of the needle beds but is subject to a slow variation as one moves along the needle bed. That is, the periodicity of the variation in the gap along the needle beds is long in relation to the length of a presser foot (which is approximately 10 cm). Thus, a presser foot at a fixed height in relation to the knocking over bits will at some positions along the needle beds come close to or touch the knocking over bits and at other positions will be spaced further from the knocking over bits.

SUMMARY OF THE INVENTION

According to the present invention there is provided a flat V-bed knitting machine having a presser foot assembly in which a presser foot is resiliently urged downwards between knocking over bits of the two needle beds, which is characterised in that inner edges of lower portions of at least some of the knocking over bits have a smooth profile and are inwardly inclined, in the downward direction, with respect to the knocking over bits of the opposite needle bed.

Thus, the downwardly urged presser foot can move downwardly between the inwardly inclined knocking over bits until it touches the knocking over bits or the loops of the knitted fabric and will thus adjust itself to a suitable level to control the knitting action irrespective of variations in the bed gap.

It may be advantageous that all of the knocking over bits of the machine have inner edges which are so inclined, but improved holding down of the knitted fabric may be obtained if some only of the knocking over bits have such edges. For example, the inner edges of knocking over bits of one needle bed only may be inwardly inclined or alternate knocking over bits in each needle bed may have inwardly inclined edges.

In this specification, the words "vertical", "down" and "downwards" are used to indicate the direction of a line bisecting the angle between the needle beds or movement along that line as taken by knitted material during a knitting operation. Such a line would be truly vertical when a conventional V-flat knitting machine is arranged in its usual attitude for operation. However, the use of the words "vertical", "down" and "downwards" should not be taken as indicating that the present invention is limited to conventional forms of V-flat knitting machines or to such machines only when arranged in the usual attitude for operation.

BRIEF DESCRIPTION OF THE DRAWING

The invention will be further described, by way of example, with reference to the accompanying drawing wherein the single FIGURE is a cross-section showing part of the needle beds, knocking over bits and an associated element in a flat V-bed knitting machine fitted with knocking over bits in accordance with the invention.

DESCRIPTION OF THE PREFERRED EMBODIMENTS

The flat V-bed knitting machine shown in the drawing has two needle beds 5 and 6. In each needle bed is formed a series of slots in which are mounted, in conventional manner, knocking over bits, two of which 7 and 8 are visible in the drawing. The upper portions 9 and 10 of the inner edges 11 and 12 of the knocking over bits 7 and 8 are of conventional shape (which varies from one machine manufacturer to another) but the lower portions 13 and 14 of the inner edges 11 and 12 of the knocking over bits are inwardly inclined, in the downward direction with respect to one another. That is, each of the lower portions 13 and 14 is inclined towards the other of those lower portions in the downward direction. In the present machine, the lower portions 13 and 14 of the inner edges 11 and 12 are straight. The angle of inward inclination, that is the angle a between the lower portion 13 or 14 and the vertical, shown, for example, as a broken line 15 in the drawing may be, for example, in the range 2° to 10°, a preferred range being 5° to 7°.

All the knocking over bits in both needle beds may have inwardly inclined lower portions of their inner edges. Alternatively, the knocking over bits of one needle bed only may have inwardly inclined lower portions, the knocking over bits of the other needle bed preferably having vertical portions on their inner edges as illustrated by the broken line 15 in the drawing. In this case the angle of inclination of the knocking over bits will probably be chosen nearer the higher end of the ranges indicated and a preferred range of inclinations, if knocking-over bits of only one needle bed have inclined inner edges, is from 6° to 8° whereas if knocking-over bits of both needle beds have inclined inner edges, a preferred overall range for the angle of inclination is 2° to 8° and the most preferred range is, as stated above, from 5° to 7°.

A further possibility is that some only of the knocking over bits of one or both needle beds have inwardly inclined lower portions, for example alternate knocking over bits in one or both needle beds.

At the lower extremities of the lower edge portions 13 and 14 of the knocking over bits 7 and 8 in the drawing, each knocking over bit has a straight horizontal underneath edge portion 16 or 17 extending outwardly from the edge portion 13 or 14. As an alternative, these edge portions 16 and 17 may be upwardly and outwardly inclined as illustrated by the broken line 18 in the drawing in relation to the knocking over bit 7. The lowermost inner edges 19 and 20 of the knocking over bits are preferably downwardly and outwardly inclined as shown in the drawing. These lowermost inner edges 19 and 20 may however be vertical.

The lower edge portions 13 and 14 of the inner edges 11 and 12 of the knocking over bits may be regarded as extending from a level A indicated by a broken line in the drawing where the upper portions 9 and 10 of the said inner edges, which have a greater inward inclination than the lower portions 13 and 14, merge into the lower portions. The lower portions 13/14 extend down between the needle beds to the level B where they meet the horizontal underneath edge portions 16 and 17. The distance from level A to level B, which is approximately the length of each lower portion 13 or 14, is preferably not less than 1.5 times the gauge of the knitting machine and not greater than twice the gauge of the knitting machine, where the gauge of the machine is defined as the distance between the centres of adjacent needles in the same needle bed.

The machine illustrated in the drawing has two presser feet 23 associated with each cam system of the machine. Each pair of presser feet is carried on a blade 24 extending downwardly between the knocking over bits of the machine. The blade 24 and the presser feet 23 may be mounted, for example, in the manner described in British Patent Specification No. 1,588,970 which refers back to the presser foot mounting described in British Patent Specification No. 1,288,043.

In the presser foot mounting of British Patent Specification No. 1,588,970 the blade (here the blade 24) carrying two presser feet is slidably mounted on a downwardly directed supporting arm and the blade, and thus the presser feet, are resiliently urged downward on the supporting arm, that is in the direction downwardly between the needle beds in the present drawing. Preferably, the downward load applied to the presser foot is as set out in the following table:

TABLE

| Machine gauge | Maximum load on presser foot (gm) |
|---|---|
| E12 | 300 |
| E10 | |
| E8 | 600 |
| E7 | |
| E6 | 1,100 |
| E5 | |

For the purpose of the table, the gauge is defined as the number of needles contained in one inch (25.4 mm) of needle bed.

Each presser foot 23 in the present machine has a trapezoidal cross section, the upper and lower surfaces of the presser foot being parallel to one another and the side edges 25 of the presser foot being inclined downwardly and inwardly each at an angle to the vertical in the drawing between 4° and 10° and preferably equal to the angle of inward inclination of the adjacent inwardly inclined knocking over bit edges. The width of each presser foot 23 is preferably equal to the shortest distance between opposed inwardly inclined knocking over bit edges, that is the width d of each presser foot is equal to the distance d between opposed knocking over bits 7 and 8 at a distance above the level B equal to the thickness of the presser foot.

The inwardly inclined knocking over bit edges cooperate with the sprung-loaded downwardly urged presser feet to grip parts of the knitted loops between the side edges 25 of a presser foot and the lower portions 13 and 14 of the inner knocking over bit edges. The operative presser foot will be urged downwardly until the resistance to its downward movement is equal to the load applied by its resilient mounting.

It is desirable in order to provide more space between the present knocking over bits to accommodate knitted fabric during shaping, when some needles continue to knit whilst others become inactive but retain their loops, that the knocking over bits should be thinner than conventional knocking over bits for the same gauge of machine. Thus, if knocking over bits would normally be 0.6 mm thick, knocking over bits in the knitting machine described above are advantageously approximately 60% of that thickness, that is 0.4 mm thick.

As another measure to provide space to accommodate knitted fabric produced on active needles, whilst adjacent needles are inactive, the nose portions, that is the uppemost inner corners, of the needle beds may be cut back further than is shown in the accompanying drawing. The knocking over bits may then be secured more firmly by forming a hole in each knocking over bit, preferably near the inner edge and just below the line of rise of the associated needles. A wire is then threaded through all the aligned holes in the knocking over bits of the same bed in order to secure them.

What is claimed is:

1. A flat V-bed knitting machine having two needle beds, a presser foot assembly, in which a presser foot is resiliently urged downwards between the needle beds, and knocking over bits associated with each needle bed, at least some of said knocking over bits having lower portions with inner edges which have a smooth profile and are inwardly inclined, in the downward direction, with respect to the knocking over bits of the opposite needle bed.

2. A knitting machine according to claim 1, wherein all the knocking over bits of the knitting machine have inner edges which are downwardly and inwardly inclined.

3. A knitting machine according to claim 1, wherein the knocking over bits of one needle bed only are downwardly and inwardly inclined.

4. A knitting machine as claimed in claim 2, wherein the angle of inclination (to the "vertical") of the inner edge of the lower portion of each knocking over bit having an inclined inner edge lies in the range 2° to 8°.

5. A knitting machine as claimed in claim 4, wherein the said angle of inclination lies in the range 5° to 7°.

6. A knitting machine as claimed in claim 3, wherein the angle of inclination (to the "vertical") of the inner edge of the lower portion of each knocking over bit having an inclined inner edge lies in the range 2° to 10°.

7. A knitting machine as claimed in claim 6, wherein the said angle of inclination lies in the range 6° to 8°.

* * * * *